US006164555A

United States Patent [19]

Fulton et al.

[11] Patent Number: 6,164,555

[45] Date of Patent: Dec. 26, 2000

[54] RISER DEVICE FOR CREATING AN ELEVATED STRUCTURE FOR ARTIFICIAL LANDSCAPES

[75] Inventors: C. Dwayne Fulton; David L. Osment, both of Osage Beach, Mo.

[73] Assignee: Osment Models, Inc., Linn Creek, Mo.

[21] Appl. No.: 09/111,968

[22] Filed: Jul. 8, 1998

Related U.S. Application Data

[63] Continuation-in-part of application No. 08/780,852, Jan. 9, 1997.

[51] Int. Cl.[7] ..... E01B 2/00

[52] U.S. Cl. ..... 238/10 E; 238/10 F; 238/10 C; 238/10 R; 446/444; 446/447

[58] Field of Search ..... 238/10 R, 10 A, 238/10 B, 10 C, 10 E, 10 F; 446/444, 447, 467

[56] References Cited

U.S. PATENT DOCUMENTS

| | | | |
|---|---|---|---|
| 2,120,251 | 7/1938 | Johnson . | |
| 3,684,173 | 8/1972 | Casadio | 238/10 E |
| 4,241,875 | 12/1980 | Vandenbrink . | |
| 4,540,119 | 9/1985 | Neuhierl | 238/10 R |
| 4,575,350 | 3/1986 | Hippely et al. | 446/368 |
| 4,826,076 | 5/1989 | Hesse | 238/10 |
| 4,955,537 | 9/1990 | Bratovz | 238/10 B |

FOREIGN PATENT DOCUMENTS

| | | |
|---|---|---|
| 2068754 | 8/1981 | United Kingdom . |
| 9206757 | 4/1992 | WIPO . |

*Primary Examiner*—S. Joseph Morano
*Assistant Examiner*—Frantz Jules
*Attorney, Agent, or Firm*—Shook, Hardy & Bacon L.L.P.

[57] ABSTRACT

A structure is provided for creating an elevated subroadbed for an artificial landscape. The structure includes a flexible riser section of a given length that has a generally planar bottom. The riser section also has a generally planar top extending and supported parallel to the bottom so that the height of the section is consistent along its entire length. The riser is provided with first and second side walls, which each have a series of channels that extend into the riser in spaced apart relation. The channels allow the riser to be positioned in a radius. The top forms an elevated surface that enables low-lying areas to be more easily created on the artificial landscape below the elevated surface.

6 Claims, 3 Drawing Sheets

10
12
14
16
18
20
22
24
26
28
30
36
38
42
4.
4.

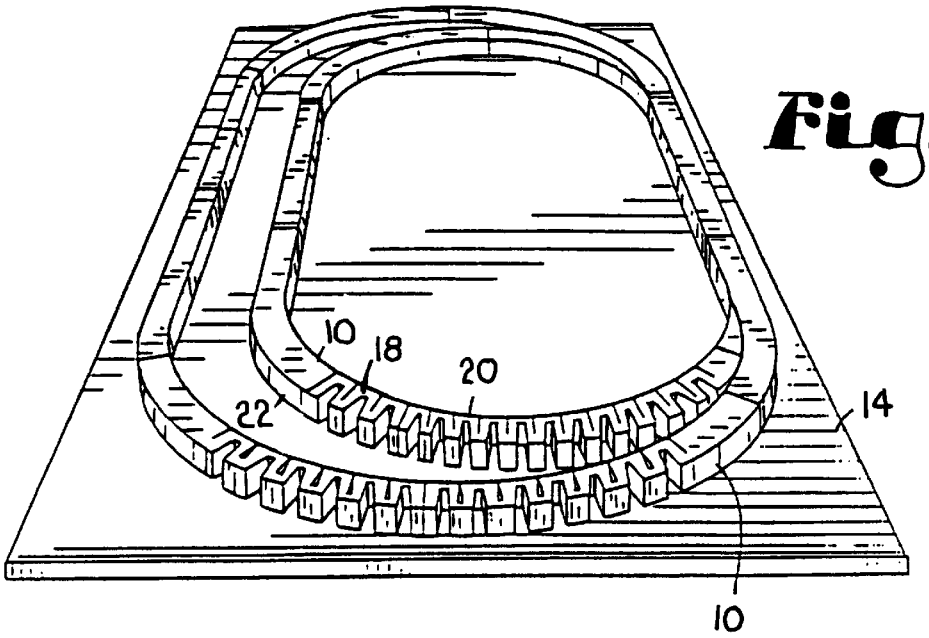
Fig. 6.
Fig. 7.
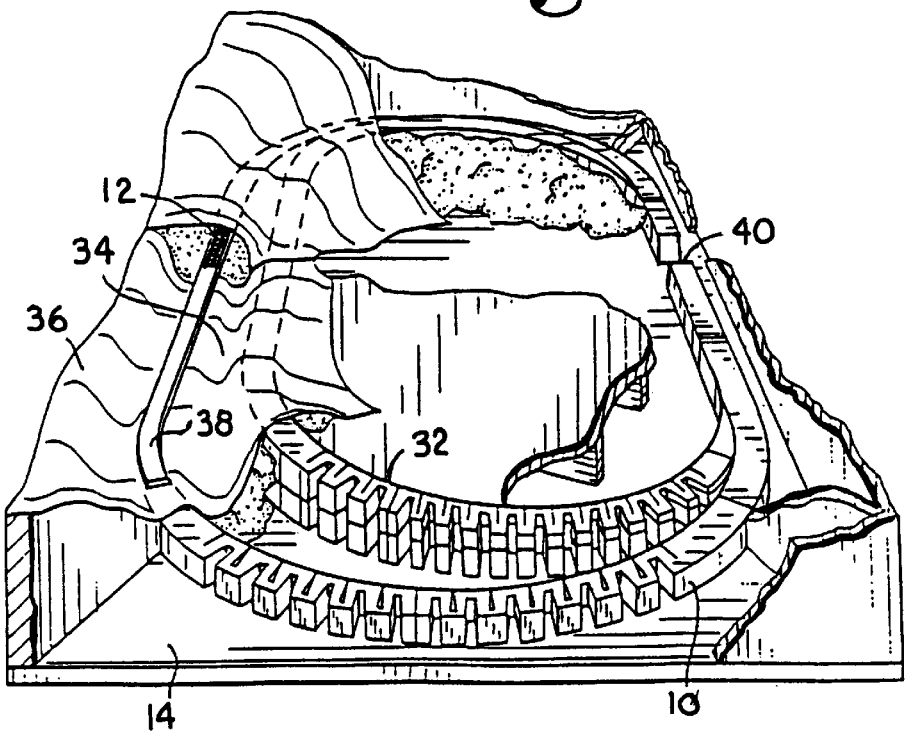

RISER DEVICE FOR CREATING AN ELEVATED STRUCTURE FOR ARTIFICIAL LANDSCAPES

CROSS REFERENCE TO RELATED APPLICATIONS

This application is a continuation-in-part of, and claims the benefit of, U.S. Application Ser. No. 08/780,852, filed Jan. 9, 1997.

STATEMENT REGARDING FEDERALLY SPONSORED RESEARCH OR DEVELOPMENT

Not Applicable.

BACKGROUND OF THE INVENTION

The present invention relates to a novel method and structure for constructing an elevated structure for an artificial landscape. More particularly, the invention is directed to a method and structure which can be used to form a model subroadbed above a base surface so that low-lying areas can more easily be constructed.

Railroading enthusiasts and hobbyists of all ages have long enjoyed the challenge of model railroading. One of the challenges faced by these hobbyists is constructing a realistic layout that accurately simulates an actual landscape. Before the layout can be constructed, it must first be designed. Designing the layout includes determining the scale, size and overall shape, as well as the time period to be modeled. Further, the modeler must decide what types of industries will be represented on the layout, whether a town will be included, as well as what natural formations, such as trees, lakes and mountains will be present. Certain limitations, such as the available space and the expense involved are, of course, considered when making the above decisions. Further, the layout will include a pattern for the track on which the train will travel. This pattern may involve elevational changes for the track, to simulate grades, bridges and tunnels. The layout may also include low-lying areas, to simulate such things as rivers, ditches and valleys. After the layout is designed, it must then be constructed.

In general, railroad transportation involves a locomotive that pulls the rolling stock, which may include passenger cars and freight cars. The locomotive and the rolling stock are supported and travel along a track that is in turn supported by a roadbed. The roadbed is supported upon a subroadbed structure. Thus, in constructing a model railroad layout it is necessary to construct the subroadbed upon which the track is placed. The subroadbed that is constructed must conform to the grades in the layout, and support the track and roadbed that are placed thereon.

In the past, when low-lying areas were to be constructed, a benchwork support system is used. The benchwork is constructed of a series of wooden supports, which support pieces of a base material. Various levels of the layout may be created by supporting the various base pieces with the wooden supports at the needed heights. This allows a low-lying area to be created by supporting different base pieces at different heights. Low-lying areas would include streams or rivers, valleys, ditches and ravines. Basically, it may be desirable to simulate any low-lying area which exists in the real world. However, as may be appreciated, constructing such a benchwork is not a simple task, and requires the use of power and hand tools, as well as a high degree of skill. Further, once the benchwork is constructed, the modeler is somewhat restricted in changing the layout if any changes in the benchwork are required.

Previous methods for creating a graded subroadbed for a model landscape have also been difficult, time consuming, and noisy. The needed inclines or declines were typically constructed from wood and required the use of power tools, hammers and nails. The nature of the materials used made it difficult to construct an incline or decline with a uniform and continuous grade. The difficulty increased significantly when an incline or decline was desired to be curved so that a rise or fall in elevation could continue throughout a radius in the layout. Further, the previous methods and devices for constructing a terrain grade and subroadbed resulted in a relatively heavy layout. If the layout was desired to be somewhat portable, the added weight made it more difficult to relocate the layout.

Therefore, a method and a structure are needed that can be used to quickly and easily create a relatively lightweight subroadbed on an artificial landscape that more easily allows low-lying areas to be created. Still further, a method and structure are needed that allow a modeler to more easily change the overall layout without having to replace the layout base or benchwork.

SUMMARY OF THE INVENTION

It is an object of the present invention to provide a structure that can easily be mounted onto a base so that an elevated model subroadbed can be created that allows low-lying areas to be more easily created.

It is a farther object of this invention to provide a structure that can easily be manipulated into a variety of radiuses while providing a consistent elevated subroadbed, so that an elevated subroadbed can be formed while rounding a curve.

It is yet another object of this invention to provide a structure that is lightweight and sturdy and that can be mounted onto a base without the need for special power tools to form an elevated model subroadbed with a consistent and elevated surface.

According to the present invention, the foregoing and other objects are obtained by a structure for creating an elevated subroadbed for an artificial landscape. The structure includes a flexible riser section of a given length that has a generally planar bottom. The riser section also has a generally planar top extending and supported parallel to the bottom so that the height of the section is consistent along its entire length. The section is provided with first and second side walls, which each have a series of channels that extend into the section in spaced apart relation. The channels allow the section to be positioned in a radius. The top forms an elevated surface that enables low-lying areas to be more easily created on the artificial landscape below the elevated surface.

Additional objects, advantages, and novel features of the invention will be set forth in part in the description which follows, and in part will become apparent to those skilled in the practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

In the accompanying drawings which form a part of the specification and are to be read in conjunction therewith and in which like reference numerals are used to indicate like parts in the various views:

FIG. 6 is perspective view of a layout, showing the sections of FIG. 1 abutting one another in end-to-end relation; and FIG. 7 is a perspective view similar to FIG. 6, shown with inclines and partial landscaping added.

DETAILED DESCRIPTION OF THE INVENTION

Figure 1:
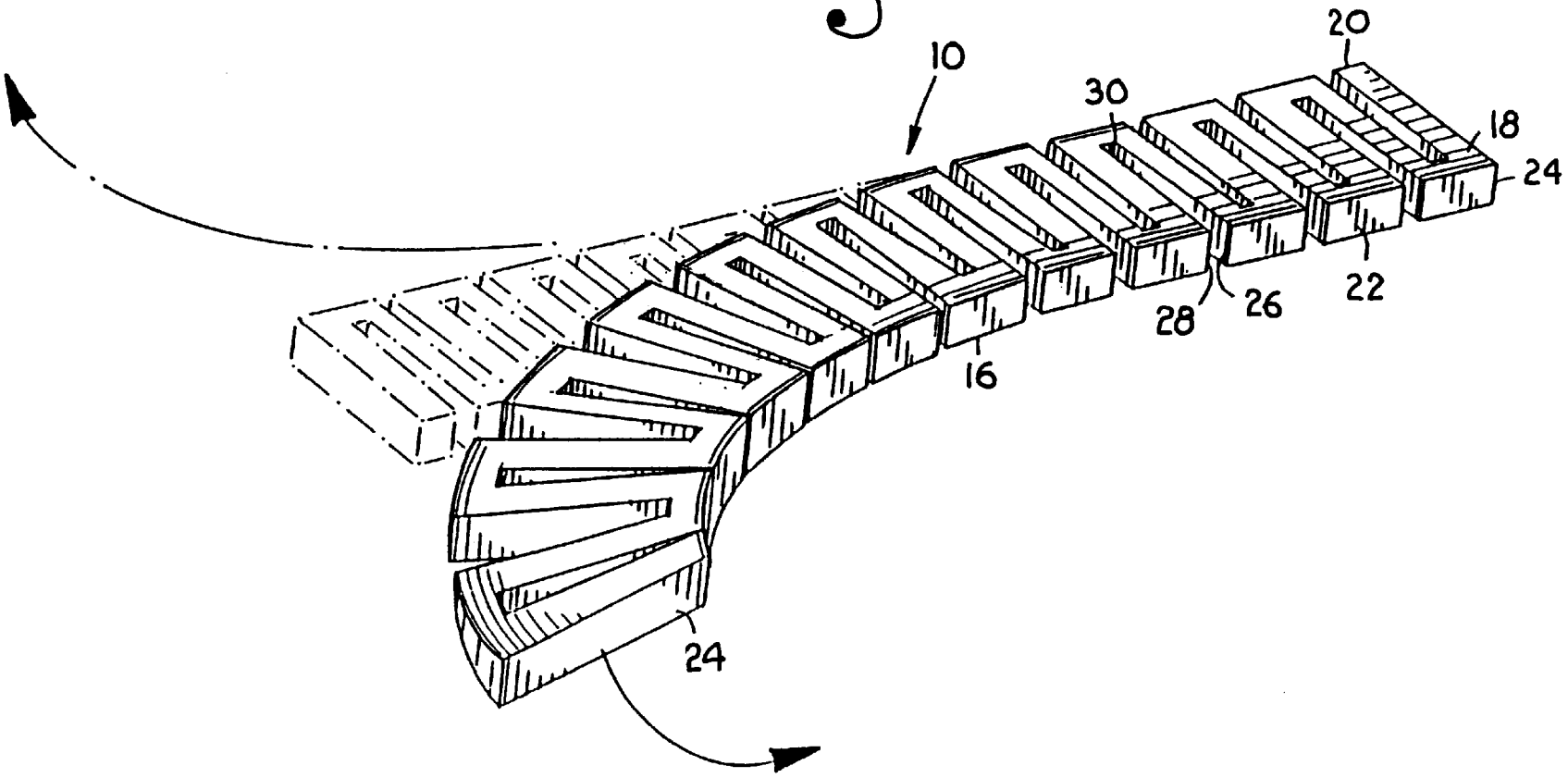
FIG. 1 is a perspective view of a flexible section according to the present invention, shown in a radiused orientation.

A flexible riser section embodying the principles of this invention is broadly designated in the drawings by reference numeral 10. Riser 10 is used to support a model train track 12 in an elevated state above a base 14, shown in FIGS. 6 and 7. With initial reference to FIGS. 1 and 2, riser 10 has a generally planar bottom surface 16, a top surface 18, and opposing parallel spaced apart side walls 20 and 22. Riser 10 further has a pair of opposed end walls 24. Top 18 is spaced above and is parallel to bottom 16 so that riser 10 elevates top 18 above base 14 at a consistent and uniform height.

Figures 2, 3, 4, 5:
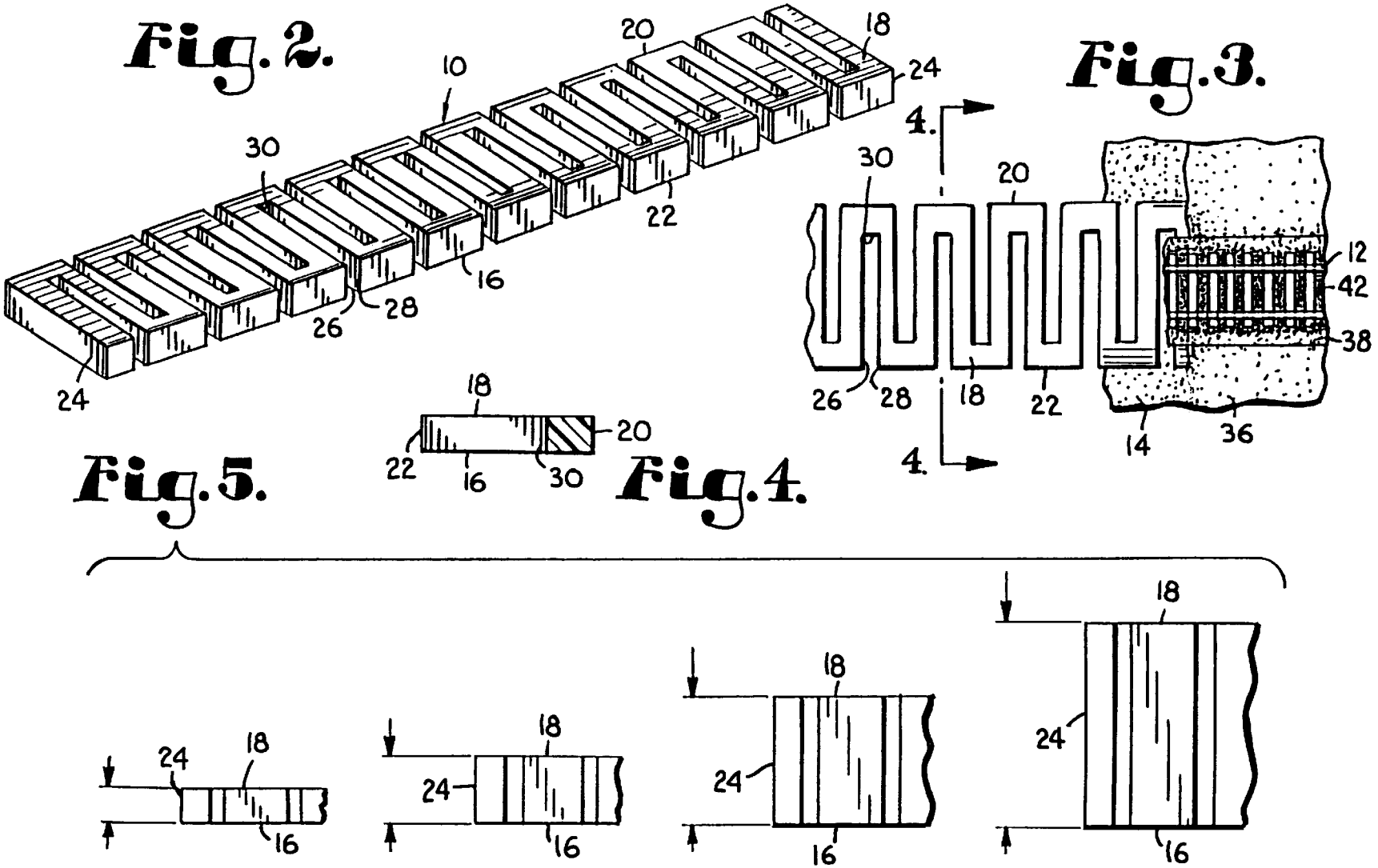
FIG. 2 is a perspective view, similar to FIG. 1, shown in a straight orientation.
FIG. 3 is a top plan view of the section of FIG. 1, shown attached to a base with a portion of track thereon and shown partially landscaped.
FIG. 4 is a cross sectional view of the section of FIG. 3, taken along line 4—4 of FIG. 2.
FIG. 5 is a series of partial side elevation views of flexible risers of the present invention, shown with varying heights.

Extending inwardly in alternating and spaced apart relation from side walls 20 and 22 are a series of channels 26, as can best be seen in FIGS. 1 and 2. Preferably, channels 26 are generally U-shaped and have an open end 28 and a closed end 30. Channels 26 allow riser 10 to be manipulated into a radius as best seen in FIGS. 1 and 6–7. In this orientation, open ends 28 of channels 26 become wider on side wall 20 and narrower on side wall 22 in the portion of riser 10 that is radiused, when riser 10 is radiused toward side wall 22 as shown in FIG. 1. Conversely, open ends 28 become wider on side wall 22 and narrower on side wall 20 in the portion of riser 10 that is radiused when riser 10 is radiused toward side wall 20. Riser 10 can only be radiused to the point at which open ends 28 become completely closed. It can thus be seen that the width of open end 28 is a determining factor of the radius which can be obtained, along with the flexibility of the material used to form riser 10. Riser 10 can be made from any material that will allow it to flex and is preferably manufactured from a polystyrene material. The polystyrene provides a sturdy and lightweight structure upon which the model train can be carried.

In use, risers 10 are placed on base 14 according to a layout that has been created and transferred to the base. The layout provides the location, shape and desired grades for track 12 and dictates where on base 14 risers 10 may be needed. Base 14 is preferably made from a lightweight and sturdy material, such as a sheet of plywood, polystyrene or other suitable base material. Risers 10 are coupled to base 14 according to the layout, using an adhesive, or other suitable attaching means. Thus, no power tools or complicated methods are required to attach riser 10 to base 14. As shown in FIG. 6, risers 10 can be coupled to base 14 in a straight or a curved configuration to correspond to the desired location of track 12. The height of riser 10 can be varied, as best represented in FIG. 5 to accommodate the desired elevation for track 12. After risers 10 are in place, it may be desirable to add flexible incline sections 32, as shown in FIG. 7. Incline sections 32 are preferably constructed of the same material as risers 10, and are also equipped with a series of channels that allow sections 32 to be bent into a curved configuration. Sections 32 are more fully described in pending U.S. patent application Ser. No. 08/780,852, filed Jan. 9, 1997, the specification of which is incorporated herein by reference.

After risers 10 and sections 32 have been installed, additional landscaping may be applied or installed. By using risers 10 to elevate the level of track 12, low-lying areas may be more easily created on the layout. For example, as shown in FIG. 7, a ravine 34 may be created, as well as other low-lying areas. As another example, an opening 40 may be created in risers 10, over which track 12 will extend, to simulate a bridge over a river or stream. Risers 10 are preferably made from a material, such as polystyrene, which may easily be cut to make such an opening.

It can therefore be seen that a series of risers 10 can be placed in end to end relation to form an elevated surface on which to place track 12. Sections 32 can be added to form inclines and declines on the layout as desired. Therefore, risers 10 and sections 32 can be used to elevate track 12 to a desired elevation, as well as constructing inclines and declines. By elevating track 12 relative to base 14, low-lying areas may be more easily constructed on the layout.

After risers 10 and any needed sections 32 have been applied to base 14, it is necessary to attach track 12 thereto. Prior to attaching track 12, it is preferable to attach a plaster material 36 to top 18 of risers 10 and to the top of sections 32, as best seen in FIG. 3. A preferred use involves plaster material 36 in a cloth-sheet form, that can easily be formed to a desired shape. Plaster material 36 hardens in place, forming a hard shell that may finished as desired. After placing plaster cloth 36 over risers 10 and sections 32, a roadbed 38 is placed on top of the plaster cloth. Roadbed 38 is used to support track 12, which is placed directly on the roadbed, as best seen in FIG. 3. After track 12 is in place, a ballast 42 is placed over track 12, as is known to those of skill in the art. Ballast 42 is typically made from an aggregate material as is known in the art, and is attached to roadbed 38 using an adhesive or other suitable attaching means. Thereafter, terrain features such as rocks, tunnels and retaining walls can be added to enhance the appearance and realism of the layout, as is shown in FIG. 7, and is well-known in the art.

In another embodiment of the present invention, a method is provided for creating an elevated subroadbed on an artificial landscape. The method involves coupling to a base in a desired location a number of flexible riser sections 10 in end-to-end relation. The risers 10 have a generally planar bottom 16, a top 18 extending parallel to the bottom, and first and second side walls 20 and 22. The side walls have a series of channels 26 extending into the riser that allow it to be positioned in a radius. The risers thus form an elevated surface above the base upon which a model track can be placed, which enables low-lying areas to be created above the base and below the top.

From the foregoing, it will be seen that this invention is one well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. Structure for creating an elevated subroadbed for an artificial landscape, said structure comprising:

a flexible riser section having a given length and having a generally planar bottom, first and second side walls, said first and second side walls having a series of channels that extend into said section, from one side wall to the other, in spaced apart relation so that said section can be positioned in a radius, and a top extending and supported parallel to said bottom so that the height of said section is consistent along its entire length, said top extending from said first side wall to said second side wall and being generally planar from said first side wall to said second side wall so that the height of said section is consistent along its entire width;

wherein said top forms an elevated surface enabling low-lying areas to be more easily created below said elevated surface.

2. The structure of claim 1, wherein said channels of said first wall are offset relative to said channels of said second wall.

3. The structure of claim 2, further comprising a second section identical to the flexible riser section, said sections being placed in abutting relationship to present an elevated surface of continuous and uniform height.

4. The structure of claim 3, wherein said sections are formed from polystyrene.

5. The structure of claim 4, wherein said channels are generally U-shaped.

6. A method of creating a subroadbed on an artificial landscape, said method comprising:

coupling to a base in a desired location and in end-to-end relation a plurality of flexible riser sections, each said section having a generally planar bottom, first and second side walls having a series of channels extending into said section that allow said section to be positioned in a radius, and a top extending and supported parallel to said bottom so that the height of said section is consistent along its entire length, said top extending from said first side wall to said second side wall and being generally planar from said first side wall to said second side wall so that the height of said section is consistent along its entire width;

wherein said sections form an elevated surface above said base upon which a model track can be placed, said elevated surface enabling low-lying areas to be created above said base and below said top.

* * * * *